US008061050B2

(12) United States Patent
Argov

(10) Patent No.: US 8,061,050 B2
(45) Date of Patent: Nov. 22, 2011

(54) HYDROSTATIC SENSOR DEVICE AND METHOD FOR MEASURING BELOW-GROUND ELEVATION CHANGES IN GRADE

(76) Inventor: Shachar J. Argov, Kaneohe, HI (US)

( * ) Notice: Subject to any disclaimer, the term of this patent is extended or adjusted under 35 U.S.C. 154(b) by 0 days.

(21) Appl. No.: 12/709,284

(22) Filed: Feb. 19, 2010

(65) Prior Publication Data

US 2011/0203370 A1 Aug. 25, 2011

(51) Int. Cl.
*G01C 5/04* (2006.01)

(52) U.S. Cl. ..... 33/367; 33/1 H

(58) Field of Classification Search ..... 33/1 H, 33/302, 304, 367, 521
See application file for complete search history.

(56) References Cited

U.S. PATENT DOCUMENTS 3,967,381 A * 7/1976 Chesbro ..... 33/1 H
4,356,639 A * 11/1982 Alarcon Opazo ..... 33/367
4,397,099 A * 8/1983 Gaucher et al. ..... 33/367
4,991,302 A * 2/1991 Brewer ..... 33/367
5,307,698 A * 5/1994 Endres ..... 73/865.2
5,937,529 A * 8/1999 Brewer ..... 33/367
2003/0233759 A1* 12/2003 Taylor ..... 33/304
2010/0096186 A1* 4/2010 Ekseth et al. ..... 33/304

* cited by examiner

*Primary Examiner* — G. Bradley Bennett
(74) *Attorney, Agent, or Firm* — Leighton K. Chong

(57) ABSTRACT

A hydrostatic sensor device and method is provided for detecting changes in elevation in pipes, boreholes, and tunnels below ground. A pressure transducer for sensing differential changes in fluid pressure is provided at one end of an extensible hose or other flexible conduit, while the other end is maintained in an equalizer tank at a reference atmospheric pressure at a given elevation. As one end of the system is moved along a grade, pressure changes at the transducer end relative to the reference pressure at the equalizer end are measured corresponding to elevation changes and are recorded against a distance scale, thus providing an accurate profile of the line surveyed.

19 Claims, 7 Drawing Sheets

| Sta. (ft) | Grade | Sta. (ft) | Grade | Sta. (ft) | Grade | Sta. (ft) | Grade | Sta. (ft) | Grade | Sta. (ft) | Grade | Sta. (ft) | Grade | Sta. (ft) | Grade |
|---|---|---|---|---|---|---|---|---|---|---|---|---|---|---|---|
| 0 | 0.03 | 40 | -0.29 | 80 | -0.58 | 120 | -0.65 | 160 | -0.54 | 200 | -0.43 | 240 | -0.44 | 280 | -0.48 |
| 2 | 0.03 | 42 | -0.33 | 82 | -0.56 | 122 | -0.64 | 162 | -0.51 | 202 | -0.43 | 242 | -0.43 | 282 | -0.48 |
| 4 | 0.04 | 44 | -0.36 | 84 | -0.57 | 124 | -0.64 | 164 | -0.49 | 204 | -0.45 | 244 | -0.46 | 284 | -0.52 |
| 6 | 0.02 | 46 | -0.36 | 86 | -0.58 | 126 | -0.61 | 166 | -0.49 | 206 | -0.46 | 246 | -0.47 | 286 | -0.54 |
| 8 | 0.01 | 48 | -0.38 | 88 | -0.58 | 128 | -0.59 | 168 | -0.47 | 208 | -0.46 | 248 | -0.47 | 288 | -0.53 |
| 10 | -0.01 | 50 | -0.39 | 90 | -0.59 | 130 | -0.55 | 170 | -0.45 | 210 | -0.47 | 250 | -0.46 | 290 | -0.55 |
| 12 | -0.04 | 52 | -0.40 | 92 | -0.60 | 132 | -0.54 | 172 | -0.43 | 212 | -0.47 | 252 | -0.46 | 292 | -0.54 |
| 14 | -0.07 | 54 | -0.42 | 94 | -0.59 | 134 | -0.54 | 174 | -0.42 | 214 | -0.48 | 254 | -0.44 | 294 | -0.54 |
| 16 | -0.07 | 56 | -0.43 | 96 | -0.60 | 136 | -0.52 | 176 | -0.43 | 216 | -0.47 | 256 | -0.46 | 296 | -0.55 |
| 18 | -0.08 | 58 | -0.46 | 98 | -0.59 | 138 | -0.51 | 178 | -0.44 | 218 | -0.47 | 258 | -0.45 | 298 | -0.57 |
| 20 | -0.10 | 60 | -0.49 | 100 | -0.59 | 140 | -0.50 | 180 | -0.44 | 220 | -0.47 | 260 | -0.46 | 300 | -0.55 |
| 22 | -0.15 | 62 | -0.50 | 102 | -0.59 | 142 | -0.50 | 182 | -0.42 | 222 | -0.48 | 262 | -0.45 | 302 | -0.55 |
| 24 | -0.13 | 64 | -0.52 | 104 | -0.59 | 144 | -0.50 | 184 | -0.41 | 224 | -0.48 | 264 | -0.44 | 304 | -0.56 |
| 26 | -0.13 | 66 | -0.53 | 106 | -0.60 | 146 | -0.51 | 186 | -0.39 | 226 | -0.49 | 266 | -0.46 | 306 | -0.56 |
| 28 | -0.17 | 68 | -0.53 | 108 | -0.63 | 148 | -0.52 | 188 | -0.40 | 228 | -0.49 | 268 | -0.46 | 308 | -0.59 |
| 30 | -0.17 | 70 | -0.54 | 110 | -0.63 | 150 | -0.52 | 190 | -0.40 | 230 | -0.48 | 270 | -0.47 | 310 | -0.58 |
| 32 | -0.21 | 72 | -0.54 | 112 | -0.65 | 152 | -0.58 | 192 | -0.41 | 232 | -0.48 | 272 | -0.50 | 312 | -0.74 |
| 34 | -0.24 | 74 | -0.53 | 114 | -0.68 | 154 | -0.59 | 194 | -0.40 | 234 | -0.43 | 274 | -0.50 | | |
| 36 | -0.28 | 76 | -0.55 | 116 | -0.69 | 156 | -0.58 | 196 | -0.40 | 236 | -0.45 | 276 | -0.49 | | |
| 38 | -0.27 | 78 | -0.55 | 118 | -0.67 | 158 | -0.56 | 198 | -0.41 | 238 | -0.45 | 278 | -0.49 | | |

HYDROSTATIC SENSOR DEVICE AND METHOD FOR MEASURING BELOW-GROUND ELEVATION CHANGES IN GRADE

TECHNICAL FIELD

The present invention relates to a hydrostatic sensor device and method for detecting changes in elevation traversed in pipes, boreholes, and tunnels by sensing differential changes in fluid pressure in a hydrostatic sensor.

BACKGROUND ART

In the underground construction industry, there are instances where elevation changes in pipes, boreholes, and tunnels must be measured to a high tolerance where specific slopes and grades are required to be implemented in the construction. Post-construction pipe slope irregularities may be present for reasons including faulty design, improper subgrade preparation, inadequate backfill practices, or differential settlements. While trenchless boring technologies such as Micro-tunneling and Horizontal Directional Drilling can provide precision over long distances, trenchless pipe installations can still experience out-of-tolerance grades due to improper installation, soil conditions, etc.

Exact grade surveys of newly installed and existing pipe are difficult to obtain for in situ pipe. Deficiencies such as offset joints and severe pipe sags can be visually detected with CCTV optics. However, more gradual out-of-tolerance discrepancies are harder to detect with optical tools or with existing survey technologies. Optical tools also cannot provide grade surveys around curves, corners or submerged conditions. In micro-tunneling, the conformance of slopes and grades to specification can be determined by laser spotting lengthwise from a jacking shaft. But heat refraction due to temperature changes in the tunnel may result in inaccuracies, and laser tools cannot be used around curves.

SUMMARY OF INVENTION

Technical Problem

Post-construction grade irregularities in pipes, boreholes, and tunnels must be measured to a high tolerance to determine conformance to specifications for construction. However, conventional optical and laser spotting tools have difficulty in detecting gradual out-of-tolerance discrepancies or surveying around curves, corners or steps.

Solution to Problem

A hydrostatic sensor device and method using the principle of submergence or equalization of hydrostatic pressure in a fluid-filled body is provided for detecting changes in elevation in pipes, boreholes, and tunnels below ground. A pressure transducer for sensing differential changes in fluid pressure is provided at one end of an extensible hose or other flexible conduit, while the other end is maintained in an equalizer tank at a reference atmospheric pressure at a given elevation. Pressure changes are measured corresponding to elevation changes as one end of the sensor device is moved along a grade and are recorded against a distance scale, thus providing an accurate profile of the line surveyed.

In a preferred embodiment, water is used as the fluid, and a hose has a reference end maintained in an equalizer water and a pressure-sensing transducer at its other end which is moved by a carrier along a pipe, borehole, or tunnel being surveyed. A communication cable conveys pressure readings from the transducer to a measurement recording device. The hose and communication cable may be coupled and reeled together from transducer to operator. This method of below-ground elevation survey requires no visual connection between the system end points.

In one preferred embodiment, the hydrostatic sensor device is used to measure pipe grades in sewer (70 mm or larger diameter) pipes by a flotation vessel that drags the sensor along the sewer line bottom. In another preferred embodiment, the hydrostatic sensor device is attached to a crawler unit for traversing the length of a pipe or tunnel. In yet another embodiment, the hydrostatic sensor device is configured for precise grade determination in sewer line laterals. In still another embodiment adapted for micro-tunneling work, the hose setup can be reversed with an equalizing tank carried in a micro-tunneling boring machine and the transducer end maintained at a reference point in the jacking shaft. In yet a further embodiment, the hydrostatic sensor device is adapted for horizontal directional drilling application where precise grade determination is required.

Advantageous Effects of Invention

The present invention can provide accurate measurement of elevation changes of grade in pipes, boreholes, and tunnels below ground by sensing differential changes in fluid pressure between a transducer end and a reference end of a fluid-filled hose or flexible conduit. The hydrostatic sensor device is not limited to line-of-sight detection of conventional optical and laser spotting tools, and can measure elevation changes around curves, corners or steps. Pressure readings from the transducer are calculated as elevation changes that are recorded against distance to provide an accurate profile of the line surveyed. The invention system can perform with a high tolerance in conditions of submergence, temperature variations, varying air pressures, lack of optical connection, and along long distances having many increments of elevation changes. It is particularly advantageous in being relatively compact, mobile, easily deployed, and easily used as a stand-alone system or in conjunction with other equipment as described herein.

Other objects, features, and advantages of the present invention will be explained in the following detailed description with reference to the appended drawings.

DESCRIPTION OF EMBODIMENTS

In the following detailed description of the invention, certain preferred embodiments are illustrated providing certain specific details of their implementation. However, it will be recognized by one skilled in the art that many other variations and modifications may be made given the disclosed principles of the invention.

A fundamental physical property of a fluid is that it exerts an equal pressure in all directions at any given level in a body of fluid. The fluid pressure increases with increasing depth or "submergence" in the body of fluid. If the density of the fluid remains constant, this pressure increases linearly with the depth of "submergence". To measure gauge pressure, a constant atmospheric pressure is subjected to one side of a fluid pressure measuring system, and fluid pressure is measured at a detection side of the system. The result is that a differential gauge pressure at the detection side is measured by the difference of measured fluid pressure over atmospheric pressure. An example of a gauge pressure transducer used for water depth measurement is the Aquistar unit sold by Instrumentation Northwest, Inc., of Kirkland, Wash. Another type of device that uses the principle of equalization of hydrostatic pressure to measure fluid level is the "Dutch Level", such as the BMDL40000 unit sold by American Augers, Inc., of West Salem, Ohio.

In accordance with the present invention, a hydrostatic sensor device and method using the principle of submergence or equalization of hydrostatic pressure in a fluid-filled body is provided for detecting changes in elevation in pipes, boreholes, and tunnels below ground. The system and method operate by sensing differential changes in fluid pressure in an extensible hose or other flexible conduit extending between the hydrostatic sensor at any given elevation below ground and a reference end at ground level. In a preferred embodiment, water is used as the fluid and the hose has a reference end maintained in a water tank subject to atmospheric pressure, and a pressure-sensing transducer at its other end which is moved by a carrier along a pipe, borehole, or tunnel being surveyed. A communication cable conveys pressure readings from the transducer to a measurement recording device. Elevation changes are recorded against a distance scale, thus providing an accurate profile of the line surveyed. The hose and communication cable may be coupled and reeled together from transducer to operator.

Figure 1:
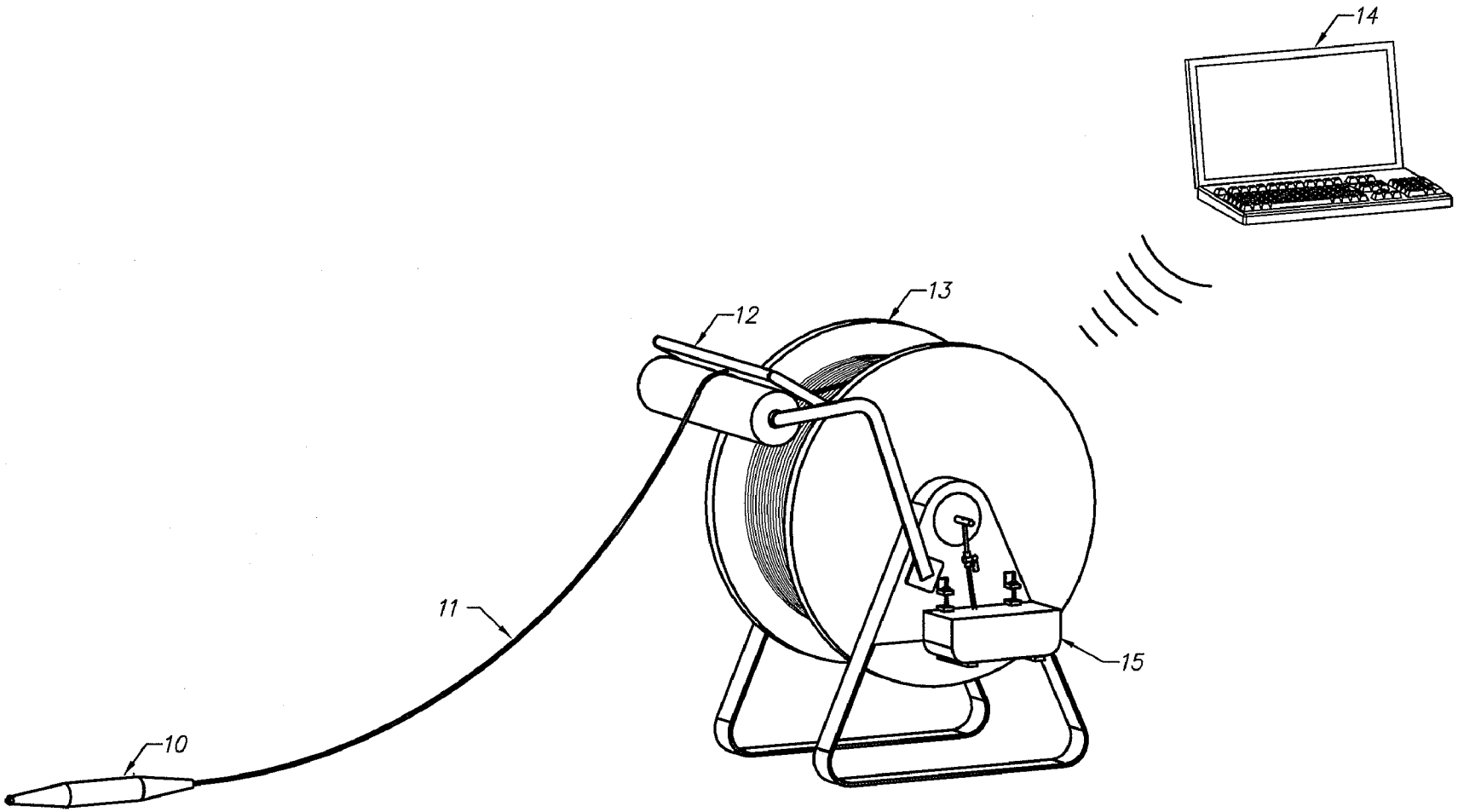
FIG. 1*a* illustrates an embodiment of a system using a hydrostatic sensor device for measuring below-ground elevation changes in grade and recording measurement data wirelessly.
FIG. 1*b* is a detailed view thereof.
Figure 1A:
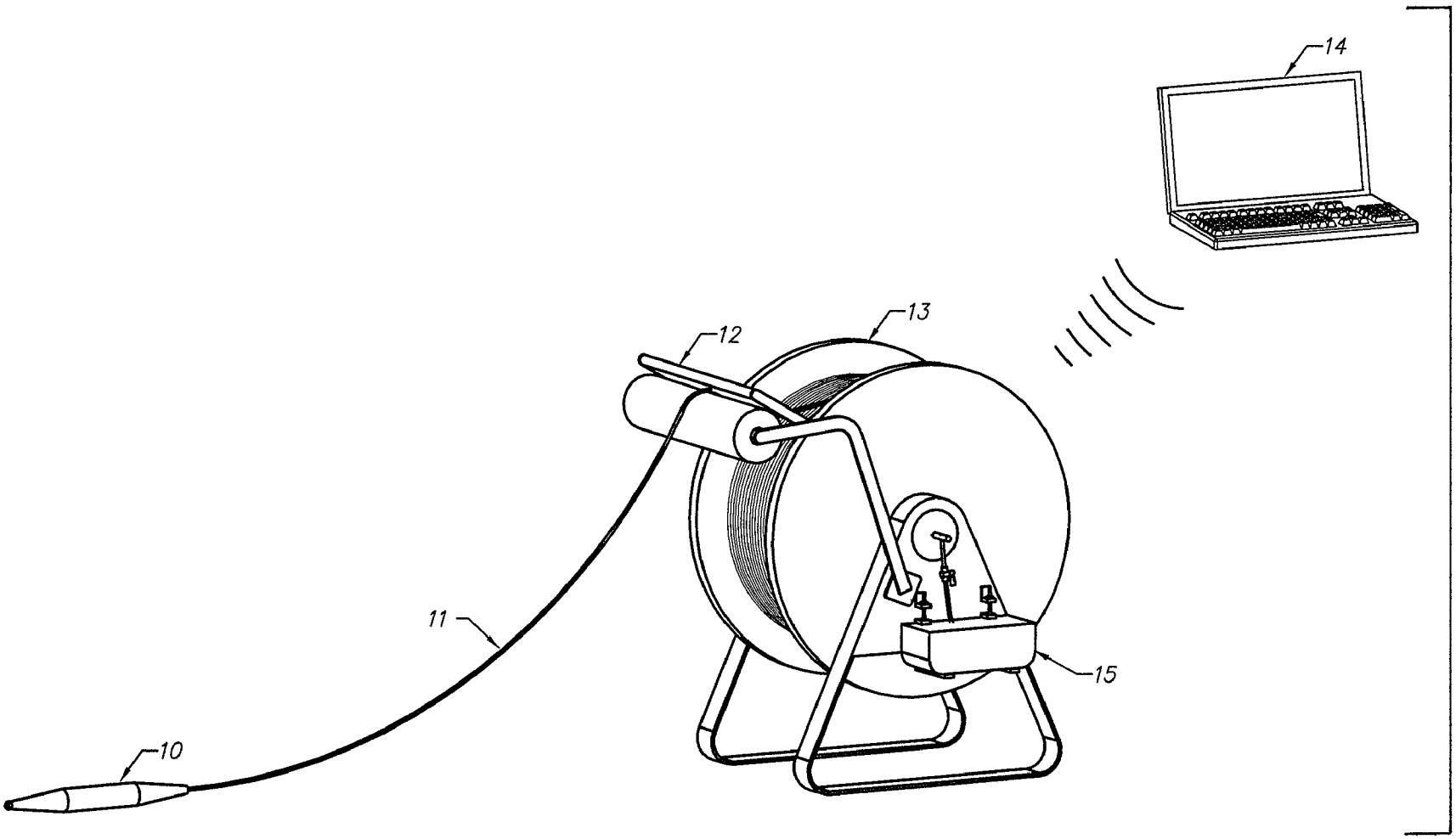

Referring to FIG. 1*a*, an embodiment of a system using a hydrostatic sensor device is shown. A sealed vessel 10 containing a fluid pressure transducer for measuring elevation changes in a pipe, bore, or tunnel below ground is connected to an end of an extensible hose or other flexible conduit 11 which also carries an attached data cable. The hose 11 (and cable) is wound on a roller 12 (which can include a hose length measurer such as a rotational counter) of reel 13 located at ground level. The ground-level end of the hose terminates in an equalizer unit 15 which is vented to atmospheric pressure as the reference pressure. A data readout device communicates measurement data from the pressure transducer to an output device 14 such as a portable computer. The data readout may be communicated from a modem unit wirelessly for convenience.

Figure 1B:
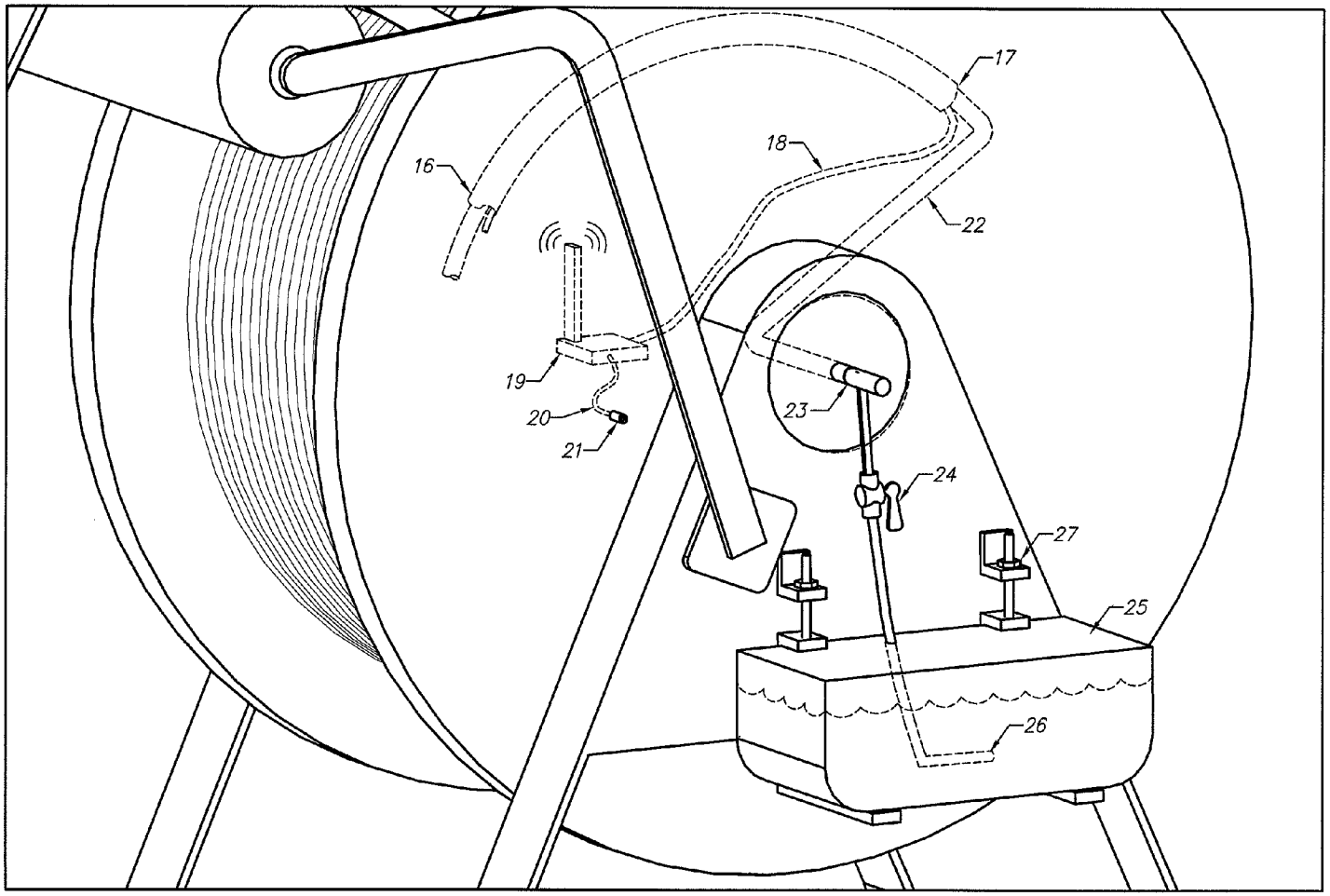

In FIG. 1*b*, a close-up view shows the end of the hose and data cable sleeved through a holder 16 on one side of the reel and terminated from an exit side 17 of the holder in separate ways. The data cable end 18 is electrically coupled to a modem unit 19 having a radio telemetry transmitter powered by a battery. The battery may be rechargeable through a battery connector 20 and adapter plug 21. The hose end 22 elbows into a rotating joint 23 connecting the rotating hose end with the static parts of the reel. A T-connector for the hose end passes through a shutoff valve 24 into an equalizing tank 25 with its outlet end 26 below the fluid level of the tank. In this example, distilled water is used as the fluid in the equalizer tank and hose. The valve 24 can be turned off when pressures in the hose approach the sensor range limit, or as needed for maintenance or repair. Equalizing tank 25 is mounted to a static support side of the reel by level adjustment mounts 27 used to adjust the water level to a reference level line.

Figure 2:
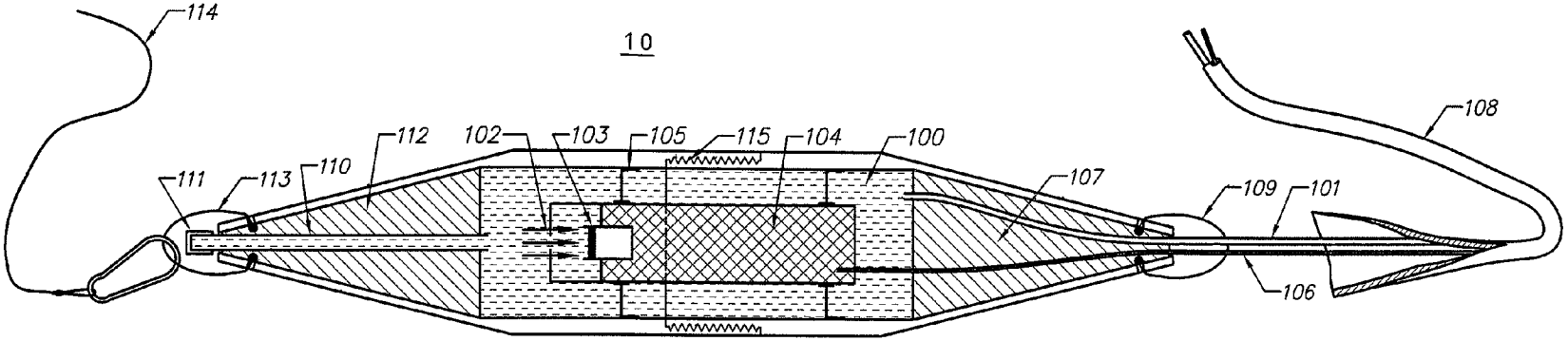
FIG. 2 shows a schematic sectional view of an enclosed vessel and pressure transducer for the hydrostatic sensor device.

In FIG. 2, the sealed vessel 10 with water pressure transducer is shown in a schematic sectional view. A fluid-filled chamber 100 in the vessel 10 is supplied by the end of the hose 101 and applies pressure indicated at 102 to pressure transducer diaphragm 103. A pressure sensor unit 104 is held at the center of the vessel 10 by spacers 105. The pressure sensor unit may be of the Aquistar brand for water depth measurement as sold by Instrumentation Northwest, Inc., of Kirkland, Wash. Pressure readings are measured by the pressure transducer 104 and the measurement data are communicated back to the operator through data communication cable 106. Both the hose end and data cable pass through a seal plug 107 before exiting the sealed vessel. Liner cable 108 is provided to protect the hose and data cable and is attached to a hook 109 on the rear end of the vessel. The front end of the vessel contains a fluid vent 110 and cap 111. This vent is left uncapped while the hose and vessel are filled with fluid to remove all air from the chamber 100, and then capped during system operation. The vent hose passes through a seal 112 for the fluid-filled chamber 110. A hook 113 may be used to connect the end of the vessel to a pulling cable 114 for some embodiments. The vessel may have a bifurcated structure coupled by a threaded joint 115 to open the vessel for maintenance and repair.

The pressure transducer 104 measures pressure changes in the chamber 100 supplied by the hose as the vessel 10 is moved up or down. These pressure changes are differentially measured relative to the reference atmospheric pressure at the other end of the hose terminating in the equalizer tank 25. Due to the equalization of pressure in all directions at any given level in a body of fluid (assuming uniform fluid density and no air disruption), the pressure reading at any elevation level of the sensor end is translated through any length or orientation of the hose and is limited only by the time required to equalize the system in order to obtain a hydrostatic reading. The differentially measured pressure changes correspond to the difference in elevation between the reference end at ground level and the sensor end of the hose at measurement points as it is moved along a pipe, bore or tunnel, and therefore can be converted to measurements of elevation changes for a survey of a grade or slope below ground. The reading of the pressure changes are registered by the transducer and can be recorded for analysis in an output device such as a computer.

The pressure gauge transducer can be selected or set to measure specific grade ranges. For a typical grade survey in below-ground pipe construction, the reading accuracy of the pressure transducer is preferably selected to provide an accuracy of about 0.05% of the full scale of the distance range and a resolution of 0.0006. Typically used ranges in below-ground pipe construction are illustrated in Table 1. If a project requires a different range, the vessel for the pressure transducer in the described embodiment can be opened and the sensor type changed as needed.

TABLE 1

Typically Used Ranges in Below-Ground Pipe Construction

| Resolution | Accuracy (typical) | Grade Fluctuation Range |
|---|---|---|
| 0.0006% | ±0.010 ft., 0.3 cm | 13.1 ft., 4 m |
| 0.0006% | ±0.016 ft., 0.5 cm | 29.5 ft., 9 m |
| 0.0006% | ±0.032 ft., 1 cm | 62.3 ft., 19 m |
| 0.0006% | ±0.064 ft., 1.5 cm | 95.1 ft., 29 m |
| 0.0006% | ±0.164 ft., 5 cm | 325 ft., 99 m |

The pressure transducer is designed to work within a certain range of hydrostatic pressure that may be measured as positive or negative. The pressure transducer and vessel may be positioned at any higher or lower point meeting these set range parameters. If it is placed higher, a lower pressure than atmospheric pressure is recorded, and vice versa. The height between the two hose ends is calculated according to the following parameters: $h=P/(d*g)$, where h is the height of the column of fluid, P is the atmospheric pressure, d is the density of the fluid, and g is gravity. This relationship also indicates the lower limit of fluid pressure before vacuum, cavitation, or collapse of the hose is created. For example, in water the highest possible supported column at atmospheric pressure at sea level will be approximately $h=1.01*10^5$ Pa/(1000 $Kg/m^3*9.8$ $m/s^2$), or 10.3 meters.

The pressure relationship, together with the design of the gauge, hose, equalizing tank, and other components, need to be considered for each type of construction project. For some embodiments, such as measurements of long tunnel distances or shallow and narrow openings, it may be advantageous to place the equalizing tank at the far end, which may entail measuring pressures lower than atmospheric. The advantage of such a configuration is that pairing a data cable together with the hose is not required since the reading is obtained at the operator's hose end. Using the hydrostatic sensor to measure pressures lower than atmospheric will increase reading errors as level changes increase. The system should therefore be used only in shallow range cases.

As fluids are mostly incompressible, pressure exerted on the vessel and hose may deform the system, thereby slightly changing its overall volume. The vessel is constructed of metal so as not to be susceptible to volume changes under pressure. The hose on the other hand may experience slight deformations under pressure. In order to neutralize hose level reading errors due to volume changes, the equalizing tank is used at the end of the hose to maintain the reference end at atmospheric pressure. Fluid level in the equalizing tank will remain mostly constant due to the volumetric relationship $V=A*h$, where V is volume, A is the cross section of the vessel, and h is height. As demonstrated from this relationship, a 50 mm level h drop in a 6 mm hose will translate to a fluid level h drop of only 0.9 mm in a 70 mm×30 mm area equalizing tank. When using the hydrostatic sensor in applications involving large elevation changes, such as deep boring and drilling applications, the equalizing tank level may be recalibrated to original fluid levels, using adjustment screws and/or removing and adding fluid to the tank.

The hydrostatic sensor method will provide accurate measurements of static fluid pressures as long as time is allowed before readings to equalize the system to obtain a correct hydrostatic reading. Pressure equalizing time is a function of the system acceleration, hose length, diameter, and pipe smoothness coefficient. As the system is advanced to each desired measurement position, the operator will halt and wait the calculated time for pressures to equalize, and then record a reading. This function may be facilitated by software for recording measurements in an accompanying computer.

Figure 3:
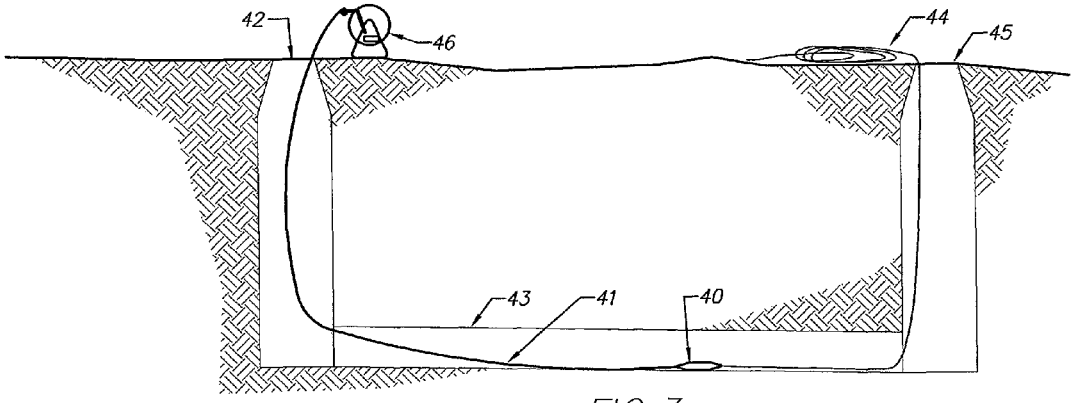
FIG. 3 illustrates a schematic view of an embodiment of the measurement system adapted for measuring elevation changes along a sewer pipe bottom.

FIG. 3 illustrates a preferred embodiment of the invention adapted for surveying a flowline profile of a sewer pipe using a stand-alone setup. This is particularly adapted for measuring pipe grades in 70 mm or larger diameter pipes, such as sewer lines connected by cleanouts or manholes. Fluid-filled sealed vessel 40 and cable 41 containing the hose, data cable, and reinforcing cable are lowered into a manhole 42, then dragged along the grade when pulled thru pipe 43 by rope 44 handled from another opening, such as a cleanout or manhole 45. The pipes must be cleaned out prior to taking readings to avoid errors due to debris or siltation. In sewer pipe applications, the transducer may be dragged along the grade as it is pulled through the pipe. Readings are obtained and recorded by the operator at reel 46 positioned at ground level.

In an example of the above-described embodiment, 130 meter of 6 mm hose is filled with distilled water. The vessel and cable conduit is lowered through the manhole or cleanout. Once the vessel sits inside the manhole, it may be assigned the known grade of the manhole. The vessel and hose may then be dragged along the sewer bottom following the pipe invert and measuring any grade changes. Grade changes are recorded as a function of hydrostatic pressure against a distance scale which is indicated by the length of hose measured by the reel counter. The measurement function may be repeated in the opposite direction and the readings compared and averaged.

Figure 4:
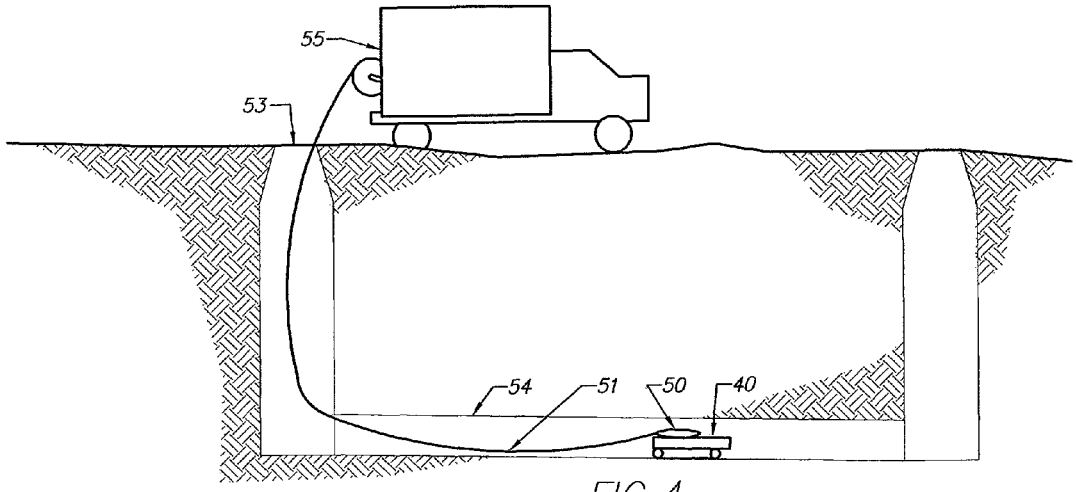
FIG. 4 illustrates a schematic view of an embodiment in which the hydrostatic sensor device is carried on a crawler to move it along a sewer pipe invert.

FIG. 4 illustrates a preferred embodiment adapted for surveying a flowline profile of a sewer pipe using a crawler. Fluid-filled sealed vessel 50 and cable 51 containing the hose, data cable, and reinforcing cable is attached to a crawler 40 and lowered through a manhole 53 into pipe 54. The crawler 40 is used to carry the vessel 50 as it traverses the length of the pipe 54. Readings are obtained and recorded by an operator (indicated in a truck 55) as supplement for additional data.

Figure 5B:
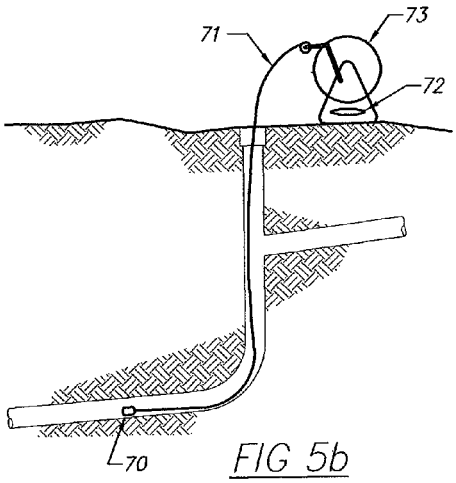
FIGS. 5*a* and 5*b* illustrate schematic views of an embodiment of the measurement system adapted for use in precise grade measurements such as in sewer line laterals.
Figure 5A:
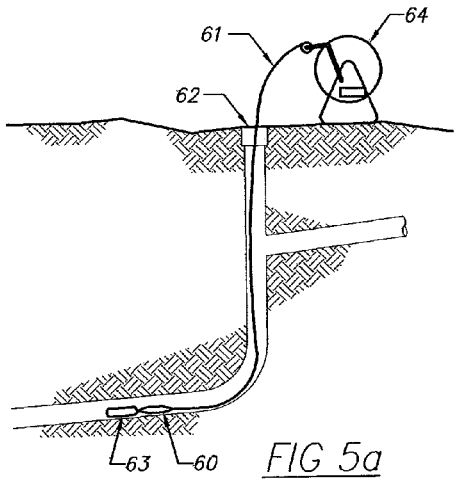

FIG. 5*a* illustrates another preferred embodiment adapted for surveying grades of short distant underground utilities, such as sewer cleanouts and laterals. Fluid-filled sealed vessel 60 is pushed with a stiff push cable 61 containing the hose and data cable through an opening 62 behind other instrumentation or a CCTV unit indicated as 63. The vessel may alternatively be incorporated into such equipment. Readings are obtained and recorded by operator at reel 64 located at ground level. FIG. 5*b* illustrates a similar embodiment as in FIG. 5*a* but with the hose end units reversed. Small equalizing tank 70 is connected to the moving hose end pushed by a stiff push cable 71, either as a stand-alone unit or in conjunction with other survey equipment or CCTV. The other hose end is connected to fluid-filled sealed vessel 72 maintained at reel 73 where an operator records pressures lower than atmospheric. This system design is preferred for shallow range surveys as discussed previously.

Figure 6:
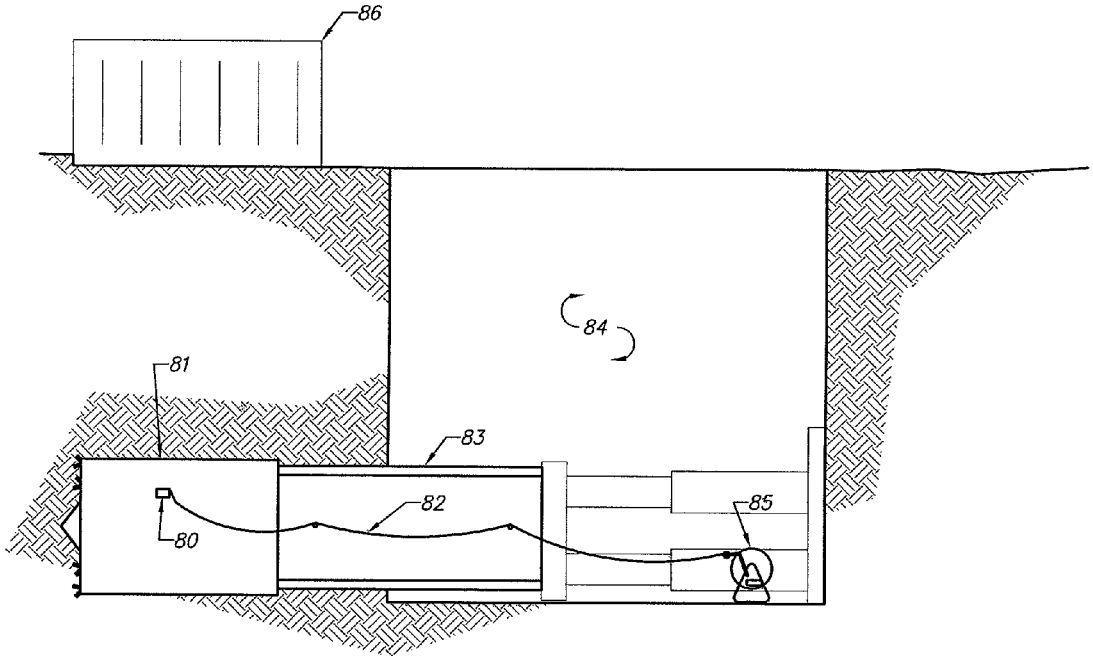
FIG. 6 illustrates a schematic view of an embodiment of the measurement system adapted for use in micro-tunneling.

FIG. 6 illustrates an embodiment adapted for micro-tunneling applications. As in FIG. 5*b*, this embodiment may use a reversed configuration in which the equalizing tank 80 is placed in a forward location inside a micro-tunneling boring machine 81. The hose 82 is connected through the following pipe 83 into jacking shaft 84 where its end is attached to a reel maintaining the fluid-filled sealed vessel 85 at a convenient location inside the jacking shaft. As the pipe is advanced by added sections, the reel may be temporarily retracted into the installed pipe, while new pipe is added, after which it is returned to the same position. As the pipe advances, the hose will stretch from the reel, and distance is measured with a distance reel counter. Readings may be communicated wirelessly to an operator located in a control cabin 86 for recording with other pertinent data. Elevation changes may be plotted against pipe advances for profile establishment. As readings may be taken over the course of several days, barometric compensation may be required in order to establish a uniform benchmark reading.

Figure 7:
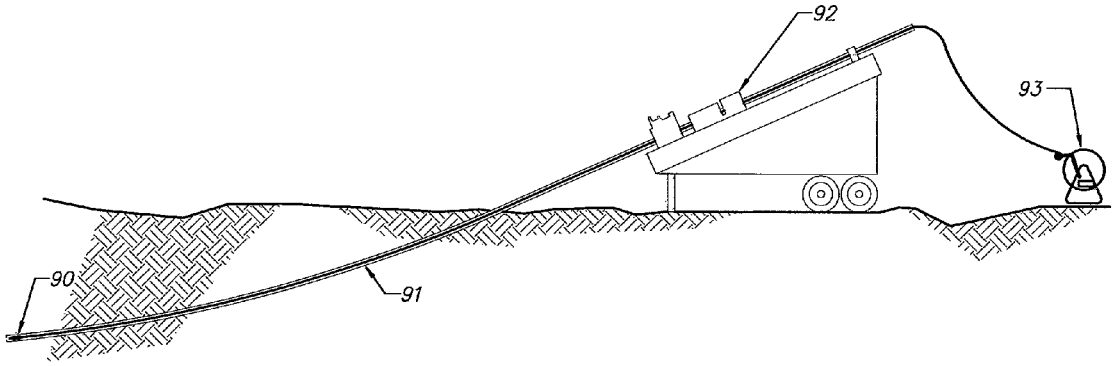
FIG. 7 illustrates a schematic view of an embodiment of the measurement system adapted for use in horizontal directional drilling.

FIG. 7 illustrates an embodiment adapted for horizontal directional drilling applications. In a similar fashion to the method described with respect to FIG. 5*a*, fluid-filled sealed vessel 90 may be lowered into a pilot tube during installation or a pipe after installation for precise elevation measurements. The hose and data cable 91 are pushed with a stiff push rod through a conduit 91 using drilling gear 92 with the outlet end located at reel 93. Other combinations that work in conjunction with drilling control systems may be used as needed. The vessel may be lowered at predetermined intervals for specific intermediate readings. The function may be repeated in the opposite direction and readings compared and averaged.

Figure 8:
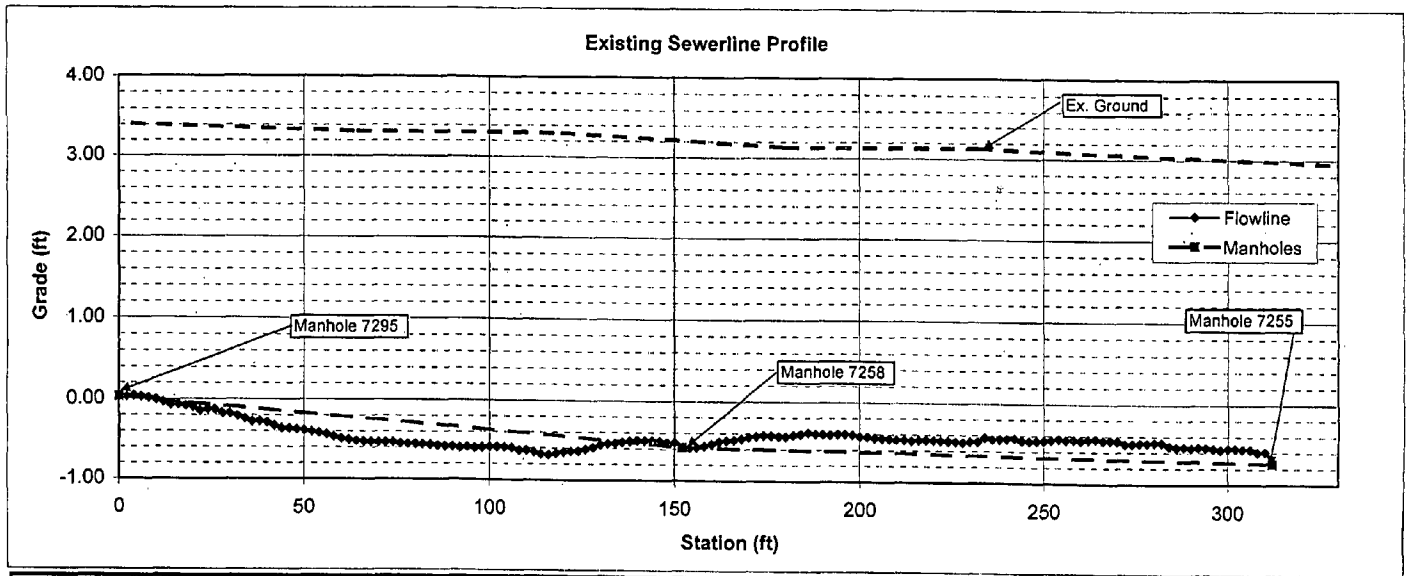
FIG 8 is a graph and related table of data for a test of the hydrostatic sensor system.

A test of a prototype of the hydrostatic sensor system was conducted, and the results obtained are shown in FIG. 8. The application was a survey of an existing sewerline profile. Readings were taken at stations of 2 ft intervals across 3 manholes. The construction-specified grade is indicated by the lower dashed line starting at 0.00 ft grade and declining to −0.80 ft. The reading at each station is measured after a time interval to allow for equalization of pressure, and the grade is measured with the pressure sensor. The readings taken (line of diamond-points) showed that the actual sewerline profile was lower than the specified grade between Manholes 7295 and 7258, and higher than the specified grade between Manholes 7258 and 7255, and that the actual grade of the second half did not maintain a gravity-induced flow profile below that of the first half measured. Thus, the hydrostatic sensor system can accurately identify a sag in a sewer line below the construction-specified grade.

INDUSTRIAL APPLICABILITY

The present invention can thus provide accurate measurement of elevation changes of grade in pipes, boreholes, and tunnels below ground, without the line-of-sight limitations of conventional optical and laser spotting tools. Using the principle of submergence or equalization of hydrostatic pressure, pressure readings of high tolerance calculated as elevation changes can be recorded against distance to provide an accurate profile of the line surveyed. The hydrostatic sensor system can perform with a high tolerance in conditions of submergence, temperature variations, varying air pressures, lack of optical connection, and along long distances having many increments of elevation changes. It is particularly advantageous in being relatively compact, mobile, easily deployed, and easily used as a stand-alone system or in conjunction with other equipment. It can be readily configured for movement by dragging or a crawler or with a push wire or with ends in reversed configuration, and in applications such as measuring sewer-line laterals, micro-tunneling, and horizontal directional drilling.

It is to be understood that many modifications and variations may be devised given the above description of the general principles of the invention. It is intended that all such modifications and variations be considered as within the spirit and scope of this invention, as defined in the following claims.

TABLE II

| Sta. (ft) | Grade |
|---|---|
| 0 | 0.03 |
| 2 | 0.03 |
| 4 | 0.04 |
| 6 | 0.02 |
| 8 | 0.01 |
| 10 | −0.01 |
| 12 | −0.04 |
| 14 | −0.07 |
| 16 | −0.07 |
| 18 | −0.08 |
| 20 | −0.10 |
| 22 | −0.15 |
| 24 | −0.13 |
| 26 | −0.13 |
| 28 | −0.17 |
| 30 | −0.17 |
| 32 | −0.21 |
| 34 | −0.24 |
| 36 | −0.28 |
| 38 | −0.27 |
| 40 | −0.29 |
| 42 | −0.33 |
| 44 | −0.36 |
| 46 | −0.36 |
| 48 | −0.38 |
| 50 | −0.39 |
| 52 | −0.40 |
| 54 | −0.42 |
| 56 | −0.43 |
| 58 | −0.46 |
| 60 | −0.49 |
| 62 | −0.50 |
| 64 | −0.52 |
| 66 | −0.53 |
| 68 | −0.53 |
| 70 | −0.54 |
| 72 | −0.54 |
| 74 | −0.53 |
| 76 | −0.55 |
| 78 | −0.55 |
| 80 | −0.56 |
| 82 | −0.56 |
| 84 | −0.57 |
| 86 | −0.58 |
| 88 | −0.58 |
| 90 | −0.59 |
| 92 | −0.60 |
| 94 | −0.59 |
| 96 | −0.60 |
| 98 | −0.59 |
| 100 | −0.59 |
| 102 | −0.59 |
| 104 | −0.59 |
| 106 | −0.60 |
| 108 | −0.63 |
| 110 | −0.63 |
| 112 | −0.65 |
| 114 | −0.68 |
| 116 | −0.69 |
| 118 | −0.67 |
| 120 | −0.65 |
| 122 | −0.64 |
| 124 | −0.64 |
| 126 | −0.61 |
| 128 | −0.59 |
| 130 | −0.55 |
| 132 | −0.54 |
| 134 | −0.54 |
| 136 | −0.52 |
| 138 | −0.51 |
| 140 | −0.50 |
| 142 | −0.50 |
| 144 | −0.50 |
| 146 | −0.51 |
| 148 | −0.52 |
| 150 | −0.52 |
| 152 | −0.58 |
| 154 | −0.59 |

TABLE II-continued

| Sta. (ft) | Grade |
|---|---|
| 156 | −0.58 |
| 158 | −0.56 |
| 160 | −0.54 |
| 162 | −0.51 |
| 164 | −0.49 |
| 166 | −0.49 |
| 168 | −0.47 |
| 170 | −0.45 |
| 172 | −0.43 |
| 174 | −0.42 |
| 176 | −0.43 |
| 178 | −0.44 |
| 180 | −0.44 |
| 182 | −0.42 |
| 184 | −0.41 |
| 186 | −0.39 |
| 188 | −0.40 |
| 190 | −0.40 |
| 192 | −0.41 |
| 194 | −0.40 |
| 196 | −0.40 |
| 198 | −0.41 |
| 200 | −0.43 |
| 202 | −0.43 |
| 204 | −0.45 |
| 206 | −0.46 |
| 208 | −0.46 |
| 210 | −0.47 |
| 212 | −0.47 |
| 214 | −0.48 |
| 216 | −0.47 |
| 218 | −0.47 |
| 220 | −0.47 |
| 222 | −0.48 |
| 224 | −0.48 |
| 226 | −0.49 |
| 228 | −0.49 |
| 230 | −0.48 |
| 232 | −0.48 |
| 234 | −0.43 |
| 236 | −0.45 |
| 238 | −0.45 |
| 240 | −0.44 |
| 242 | −0.43 |
| 244 | −0.46 |
| 246 | −0.47 |
| 248 | −0.47 |
| 250 | −0.46 |
| 252 | −0.46 |
| 254 | −0.44 |
| 256 | −0.46 |
| 258 | −0.45 |
| 260 | −0.46 |
| 262 | −0.45 |
| 264 | −0.44 |
| 266 | −0.46 |
| 268 | −0.46 |
| 270 | −0.47 |
| 272 | −0.50 |
| 274 | −0.50 |
| 276 | −0.49 |
| 278 | −0.49 |
| 280 | −0.48 |
| 282 | −0.48 |
| 284 | −0.52 |
| 286 | −0.54 |
| 288 | −0.53 |
| 290 | −0.55 |
| 292 | −0.54 |
| 294 | −0.54 |
| 296 | −0.55 |
| 298 | −0.57 |
| 300 | −0.55 |
| 302 | −0.55 |
| 304 | −0.56 |
| 306 | −0.56 |
| 308 | −0.59 |

TABLE II-continued

| Sta. (ft) | Grade |
|---|---|
| 310 | −0.58 |
| 312 | −0.74 |

The invention claimed is:

1. A hydrostatic sensor device for measuring below-ground elevation changes of a grade comprising:

an extensible hose or other flexible conduit filled with a fluid of constant density; a pressure transducer provided at one end of the hose for sensing differential changes in fluid pressure at said one end relative to a reference end at a given elevation;

a differential pressure readout device provided at an opposite end of the hose for providing differential pressure readings of fluid pressure sensed by said pressure transducer compared to the reference end at the opposite end of the hose which is maintained at a reference atmospheric pressure, an electronic communication line coupled to and extending along the hose for electronically connecting said pressure transducer to said differential pressure readout device; and a hose reel mechanism for reeling in the hose and pulling said pressure transducer at the one end of the hose along a grade;

wherein said pressure transducer at the one end of the hose is can be moved along a grade below ground, and differential pressure changes are measured by said pressure transducer end corresponding to elevation changes of the grade relative to the reference end.

2. A hydrostatic sensor device according to claim 1, wherein the measured elevation changes are recorded against a distance scale, thus providing an accurate profile of the line surveyed.

3. A hydrostatic sensor device according to claim 1, wherein the pressure transducer end is moved along the grade and the reference end is coupled to a hose reel located at ground level.

4. A hydrostatic sensor device according to claim 1, wherein the pressure transducer end is coupled to a hose reel located at ground level and the reference end is moved along the grade.

5. A hydrostatic sensor device according to claim 1, adapted for micro-tunneling, wherein the pressure transducer end is moved along a pipe tunnel and the reference end is coupled to a hose reel located in a jacking shaft for the pipe tunnel.

6. A hydrostatic sensor device according to claim 1, adapted for horizontal directional drilling, wherein the pressure transducer end is pushed along the grade by a stiff push wire and the reference end is coupled to a hose reel located at ground level.

7. A hydrostatic sensor device according to claim 1, adapted for shallow range surveys, wherein the pressure transducer end is coupled to a hose reel located at ground level and the reference end is moved along the grade.

8. A hydrostatic sensor device according to claim 1, wherein the pressure transducer is attached to a crawler unit for crawling along a grade.

9. A hydrostatic sensor device according to claim 1, wherein water is used as the fluid, and the hose has its reference end maintained in an equalizer water tank subject to atmospheric pressure.

10. A hydrostatic sensor device according to claim 9, wherein the pressure transducer is a water depth pressure gauge.

11. A hydrostatic sensor device according to claim 9, wherein the pressure transducer is enclosed in a water-filled chamber of a carrying vessel and water is supplied into said chamber from the hose coupled to a rear end of the vessel.

12. A hydrostatic sensor device according to claim 11, wherein a water vent communicating into the chamber is provided at a front end of the vessel and is covered by a cap, wherein the vent is left uncapped when the hose and chamber are filled with water to remove all air from the chamber.

13. A hydrostatic sensor device according to claim 11, wherein the vessel has a bifurcated structure coupled by a threaded joint to enable opening the vessel for maintenance and repair.

14. A hydrostatic sensor device according to claim 1, wherein the measured elevation changes are recorded for analysis in an output device such as a computer.

15. A method for hydrostatically measuring below-ground elevation changes of a grade comprising:

providing an extensible hose or other flexible conduit filled with a fluid of constant density having a pressure transducer at one end of the hose for sensing differential changes in fluid pressure and a reference end at an opposite end of the hose which is maintained at a reference atmospheric pressure, coupling an electronic communication line to and extending along the hose for electronically connecting said pressure transducer to said differential pressure readout device;

reeling in the hose and pulling said pressure transducer at the one end of the hose along a grade; and measuring differential pressure changes at said pressure transducer end corresponding to elevation changes of the grade relative to the reference end so as to enable accurate mapping of the elevation changes along the grade.

16. A method for hydrostatically measuring below-ground elevation changes of a grade according to claim 15, wherein the measured elevation changes are recorded against a distance scale, thus providing an accurate profile of the line surveyed.

17. A method for hydrostatically measuring below-ground elevation changes of a grade according to claim 16, wherein the pressure transducer end is moved along the grade and the reference end is coupled to a hose reel located at ground level.

18. A method for hydrostatically measuring below-ground elevation changes of a grade according to claim 15, wherein the pressure transducer end is coupled to a hose reel located at ground level and the reference end is moved along the grade.

19. A method for hydrostatically measuring below-ground elevation changes of a grade according to claim 15, wherein the pressure transducer end is coupled to a hose reel in a fixed position and the reference end is moved along the grade.

* * * * *